US012560370B2

(12) United States Patent
Jung et al.

(10) Patent No.: US 12,560,370 B2
(45) Date of Patent: Feb. 24, 2026

(54) VENTILATION DEVICE

(71) Applicant: LG ELECTRONICS INC., Seoul (KR)

(72) Inventors: Younggyu Jung, Seoul (KR); Hakkyu Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 17/869,434

(22) Filed: Jul. 20, 2022

(65) Prior Publication Data

US 2023/0135382 A1 May 4, 2023

(30) Foreign Application Priority Data

Nov. 4, 2021 (KR) ..... 10-2021-0150734

(51) Int. Cl.
*F25D 17/08* (2006.01)
*F04D 29/28* (2006.01)

(52) U.S. Cl.
CPC ..... *F25D 17/08* (2013.01); *F04D 29/281* (2013.01); *F25D 2317/067* (2013.01); *F25D 2317/0681* (2013.01)

(58) Field of Classification Search
CPC ..... F25D 17/08; F25D 2317/067; F25D 2317/0681; F25D 17/067; F25D 2317/0683; F25D 17/062; F04D 29/281; F04D 29/282; F04D 29/30; F04D 29/422; F04D 29/4246; F04D 29/441; F04D 17/16; F04D 25/08; F04D 29/283; F04D 29/4226; F05D 2250/52
See application file for complete search history.

(56) References Cited

U.S. PATENT DOCUMENTS 6,146,092 A * 11/2000 Botros et al. ..... B60H 1/00471 415/119
6,254,336 B1 7/2001 Ahn
2001/0017203 A1* 8/2001 Ito et al. ..... F04D 29/4246 165/201

(Continued)

FOREIGN PATENT DOCUMENTS

CN 107503958 A * 12/2017 ..... F04D 29/441
CN 108533511 A * 9/2018 ..... F04D 17/16

(Continued)

OTHER PUBLICATIONS

CN 110566510 A Translation (Year: 2019).*

(Continued)

*Primary Examiner* — Jerry-Daryl Fletcher
*Assistant Examiner* — Dario Antonio Deleon
(74) *Attorney, Agent, or Firm* — Fish & Richardson P.C.

(57) ABSTRACT

A ventilation device includes a fan including a hub coupled to a rotating shaft, a plurality of blades disposed at the hub and disposed radially with respect to the rotating shaft, and a shroud connecting the plurality of blades. The ventilation device further includes a scroll guide configured to guide a cold air discharged from the fan in both directions, and first and second ducts extending from the scroll guide and extending along a rotation direction of the fan. In the first and second ducts, a length of a hub-side surface is greater than a length of a shroud-side surface.

17 Claims, 19 Drawing Sheets

(56) References Cited

U.S. PATENT DOCUMENTS

| | | | | |
|---|---|---|---|---|
| 2003/0049122 | A1* | 3/2003 | Park et al. | F04D 29/4226 415/204 |
| 2007/0266728 | A1* | 11/2007 | Lee et al. | F04D 29/4246 62/440 |
| 2008/0256971 | A1* | 10/2008 | Bae et al. | F25D 17/062 62/285 |
| 2010/0126207 | A1* | 5/2010 | Kim et al. | F04D 29/4226 62/419 |
| 2018/0298914 | A1* | 10/2018 | Nakamura et al. | F04D 29/4246 |
| 2019/0184868 | A1 | 6/2019 | Kim et al. | |
| 2019/0353183 | A1* | 11/2019 | Sakoda et al. | F04D 17/16 |
| 2021/0285458 | A1* | 9/2021 | Bailey et al. | F04D 29/422 |

FOREIGN PATENT DOCUMENTS

| | | | | |
|---|---|---|---|---|
| CN | 110388735 | A * | 10/2019 | F04D 29/441 |
| CN | 110566510 | A * | 12/2019 | F04D 29/422 |
| JP | 1998-246194 | | 9/1998 | |
| JP | 2018-066346 | | 4/2018 | |
| JP | 2018066346 | A * | 4/2018 | F04D 17/06 |
| KR | 10-2000-0006187 | | 1/2000 | |
| KR | 100389395 | | 6/2003 | |
| KR | 10-0768851 | | 10/2007 | |
| KR | 10-2012-0002738 | | 1/2012 | |
| KR | 10-2013-0075385 | | 7/2013 | |
| KR | 10-2014-0142950 | | 12/2014 | |
| KR | 101577875 | | 12/2015 | |

OTHER PUBLICATIONS

CN 110388735 A Translation (Year: 2019).*
CN 108533511 A Translation (Year: 2018).*
JP 2018066346 A Translation (Year: 2018).*
CN 107503958 A Translation (Year: 2017).*
Extended European Search Report in European Appln. No. 22186023.2, mailed on Jan. 3, 2023, 12 pages.
Office Action in Korean Appln. No. 10-2021-0150734, mailed on Apr. 24, 2023 , 16 pages (with English translation).
Notice of Allowance in Korean Appln. No. 10-2021-0150734, mailed on Jul. 4, 2023, 4 pages (with English translation).

* cited by examiner

VENTILATION DEVICE

CROSS-REFERENCE TO RELATED APPLICATIONS

This application claims the benefit of Korea Patent Application No. 10-2021-0150734, filed on Nov. 4, 2021, which is incorporated herein by reference for all purposes as if fully set forth herein.

TECHNICAL FIELD

The present disclosure relates to a ventilation device. More specifically, the present disclosure relates to a ventilation device for refrigerator with an optimal structure of a scroll.

BACKGROUND

In general, a refrigerator can cool food or prevent spoilage by providing cold air using a refrigeration cycle device including a compressor, a condenser, an expansion mechanism, and an evaporator. A refrigerator is a device that stores food for a long time in a fresh state using cold air.

In the refrigerator, a ventilation device is installed on a flow path, which blows air into a refrigerator compartment and a freezer compartment after forcing the air to flow from the refrigerator compartment and the freezer compartment through the evaporator.

A refrigerator generally includes an outer case with a front opening, an inner case disposed in the outer case, a storage compartment (e.g., a refrigerator compartment or a refrigerator compartment) disposed in the inner case, and a door that is disposed on a front surface of the outer case to open and close the storage compartment.

In this case, the refrigerator may further include an evaporator that is formed on one side of the storage compartment and heat-exchanges a refrigerant and air to generate a cold air, a cold air flow path disposed between the outer case and the inner case, and a ventilation device that circulates the cold air from the evaporator to the storage compartment through the cold air flow path.

To increase the internal capacity of the refrigerator, it is necessary to reduce the size of the evaporator, the cold air flow path, and a fan.

When the size of the evaporator generating the cold air decreases, the number of cooling fins of the evaporator may increase to increase an amount of heat exchange per unit area. When the cold air flow path narrows, a flow path resistance may increase two times or more under the same flow rate condition. Therefore, the fan requires more than twice the work.

As disclosed in prior document 1 (Korean Patent No. 10-0389395) and prior document 2 (Korean Patent No. 10-1577875), a diameter of a turbofan is generally about 110 mm to 140 mm, and a rotational speed is about 1200 rpm. Here, the turbofan may indicate a fan in which blades are formed to be convex in a rotation direction of the fan.

If the diameter of the fan is reduced to 85 mm, the rotational speed of the fan is inversely proportional to fan's diameter to the power of 3 according to the affinity laws of the fan. Therefore, the rotational speed of the fan increases up to 2600 rpm.

Further, as mentioned above, when the flow path resistance increases by more than two times as the number of cooling fins increases and the flow path narrows, the rotational speed of the fan excessively increases according to the affinity laws.

There is a problem in that noise increases due to an aerodynamic force or a vibration resultant from an excessive increase in the number of revolutions of the fan.

There is also a problem in that the excessive increase in the number of revolutions of the fan reduces the lifespan of components such as a motor and an oil-impregnated bushing bearing.

PRIOR ART DOCUMENT (Patent Document 1) Korean Patent No. 10-0389395 B (published on Jun. 27, 2003)

(Patent Document 2) Korean Patent No. 10-1577875 B (published on Dec. 28, 2015)

SUMMARY

An object of the present disclosure is to provide a ventilation device capable of reducing the number of revolutions of a fan while increasing an internal capacity of a refrigerator.

Another object of the present disclosure is to provide a ventilation device for reducing a noise due to an aerodynamic force or a vibration generated by an increase in the number of revolutions of a fan.

Another object of the present disclosure is to provide a ventilation device capable of improving lifespan of components of a refrigerator.

Another object of the present disclosure is to provide a ventilation device capable of improving efficiency by preventing a cold air from flowing backward and preventing a vortex from occurring.

Another object of the present disclosure is to provide a ventilation device capable of reducing the number of revolutions of a fan by reducing a minimum shaft power.

Another object of the present disclosure is to provide a ventilation device capable of improving discharge efficiency of a cold air discharged from a fan.

Another object of the present disclosure is to provide a ventilation device capable of reducing a vibration and a noise generated by a difference in a gap between a fan and a scroll.

In order to achieve the above and other objects, in one aspect of the present disclosure, there is provided a ventilation device comprising a fan comprising a hub coupled to a rotating shaft, a plurality of blades disposed at the hub and disposed radially with respect to the rotating shaft, and a shroud connecting the plurality of blades, a scroll guide configured to guide a cold air discharged from the fan in both directions, and first and second ducts extending from the scroll guide and extending along a rotation direction of the fan.

In this case, in the first and second ducts, a length of a hub-side surface may be greater than a length of a shroud-side surface.

Hence, the present disclosure can improve efficiency of the ventilation device by preventing a cold air, that is discharged from the fan and passes through the first and second ducts, from flowing backward and preventing a vortex from occurring.

The first duct may comprise a first surface connecting a first hub-side surface and a first shroud-side surface, and a second surface that connects the first hub-side surface and the first shroud-side surface and is disposed along the rotation direction of the fan as compared to the first surface. The first surface and the second surface may form a predetermined angle.

An angle between a straight line passing through a shroud-side cutoff point of the second surface and a center of the fan and a straight line passing through a hub-side cutoff point of the second surface and the center of the fan may be 15° to 35°. Hence, the present disclosure can reduce the number of revolutions of the fan by reducing a minimum shaft power.

The first surface may comprise a first curved portion extending from the scroll guide and a first straight portion extending from the first curved portion. The second surface may comprise a second straight portion extending from the scroll guide.

In this case, an angle between the first straight portion and a line extending in a horizontal direction from the center of the fan may be 32° to 43°. Hence, the present disclosure can reduce noise generated in the fan by reducing the minimum shaft power.

An angle between the first straight portion and a hub-side line of the second straight portion may be 32.5° to 35.5°. Hence, the present disclosure can reduce the number of revolutions of the fan by reducing the minimum shaft power.

The second duct may comprise a third surface connecting a second hub-side surface and a second shroud-side surface, and a fourth surface that connects the second hub-side surface and the second shroud-side surface and is disposed along the rotation direction of the fan as compared to the third surface. The third surface and the fourth surface may form a predetermined angle.

A straight line passing through a shroud-side cutoff point of the fourth surface and the center of the fan and a straight line passing through a hub-side cutoff point of the fourth surface and the center of the fan may form a predetermined angle.

The third surface may comprise a second curved portion extending from the scroll guide and a third straight portion extending from the second curved portion. The fourth surface may comprise a fourth straight portion extending from the scroll guide.

In this case, an angle between the third straight portion and a line extending in a vertical direction from the center of the fan may be 63° to 69°. Hence, the present disclosure can reduce noise generated in the fan by reducing the minimum shaft power.

An angle between the third straight portion and a hub-side line of the fourth straight portion may be 6.5° to 9.5°. Hence, the present disclosure can reduce the number of revolutions of the fan by reducing the minimum shaft power.

An angle between a straight line connecting a hub-side cutoff point of the second surface and the center of the fan and a straight line connecting a hub-side cutoff point of the fourth surface and the center of the fan may be 117° to 132°. Hence, the present disclosure can provide an optimal scroll structure.

The first duct may extend in a downward direction of the scroll guide, and the second duct may extend in an upward direction of the scroll guide. Hence, the present disclosure can improve discharge efficiency of the cold air discharged from the fan.

Lines connecting shroud-side cutoff points and hub-side cutoff points of the first and second ducts may be a straight line. Static pressure rise efficiency when the lines connecting the shroud-side cutoff points and the hub-side cutoff points of the first and second ducts are a straight line can further increase as compared to when the lines connecting the shroud-side cutoff points and the hub-side cutoff points of the first and second ducts are a curved line. Accordingly, the present disclosure can reduce the generation of vortex around the cutoff points and prevent the cold air from flowing backward.

There may be a uniform distance between the scroll guide and the fan. Hence, the present disclosure can reduce a vibration and a noise generated by a difference in a gap between the fan and the scroll guide.

Cross-sectional areas of the first and second ducts may increase as the first and second ducts become far away from the fan. Hence, the present disclosure can prevent the cold air from flowing backward and can allow the cold air to flow in the duct.

The blade may be formed to be entirely concave in the rotation direction. Hence, the present disclosure can maintain the lower number of revolutions of the fan than a turbofan while increasing the internal capacity of the refrigerator. Further, the present disclosure can reduce noise due to an aerodynamic force or a vibration generated by an increase in the number of revolutions of the fan, and can increase lifespan of components of the refrigerator by reducing the number of revolutions of the fan.

The present disclosure can provide a ventilation device capable of reducing the number of revolutions of a fan while increasing an internal capacity of a refrigerator.

The present disclosure can provide a ventilation device for reducing a noise due to an aerodynamic force or a vibration generated by an increase in the number of revolutions of a fan.

The present disclosure can provide a ventilation device capable of improving lifespan of components of a refrigerator.

The present disclosure can provide a ventilation device capable of improving efficiency by preventing a cold air from flowing backward and preventing a vortex from occurring.

The present disclosure can provide a ventilation device capable of reducing the number of revolutions of a fan by reducing a minimum shaft power.

The present disclosure can provide a ventilation device capable of improving discharge efficiency of a cold air discharged from a fan.

The present disclosure can provide a ventilation device capable of reducing a vibration and a noise generated by a difference in a gap between a fan and a scroll.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts can obscure embodiments of the present disclosure. The accompanying drawings are used to help easily understand various technical features and it should be understood that embodiments presented herein are not limited by the accompanying drawings. As such, the present disclosure should be understand to extend to any alterations, equivalents and substitutes in addition to those which are particularly set out in the accompanying drawings.

In addition, a term of "disclosure" may be replaced by document, specification, description, etc.

Figure 1:
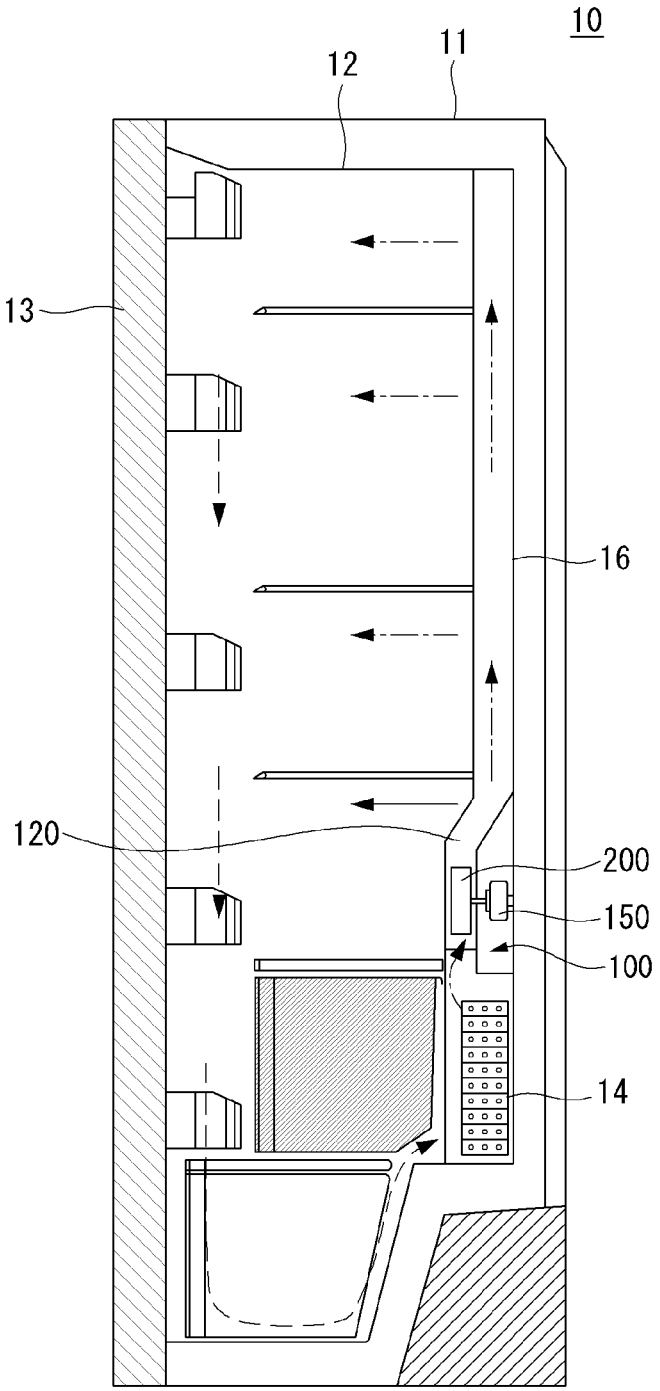
FIG. 1 is a cross-sectional view of a refrigerator according to an embodiment of the present disclosure.

FIG. 1 is a cross-sectional view of a refrigerator according to an embodiment of the present disclosure.

Referring to FIG. 1, a refrigerator 10 according to an embodiment of the present disclosure may include an outer case 11, an inner case 12, a door 13, an evaporator 14, a cold air flow path 16, and a ventilation device 100. However, the refrigerator 10 may be implemented including more or less components according to an embodiment.

The outer case 11 may have a front opening and an inner space. The outer case 11 may form an appearance of the refrigerator 10. The outer case 11 may be formed substantially in a hexahedral shape with the front opening. However, the outer case 11 is not limited thereto and can be variously changed.

The inner case 12 may be disposed inside the outer case 11. The inner case 12 may be spaced apart from the outer case 11. The inner case 12 may include an inner space. A storage compartment may be formed in the inner space of the inner case 12. The storage compartment may be referred to as a refrigerator compartment or a freezer compartment. The storage compartment may include a plurality of storage compartments. The plurality of storage compartments may be maintained in different temperature zones. One of the plurality of storage compartments may be a refrigerator compartment, and other may be a freezer compartment.

The door 13 may be disposed at a front surface of the outer case 11. The door 13 may selectively open and close the storage compartment by a user. A plurality of doors 13 may be provided depending on the number of storage compartments.

The evaporator 14 may be disposed between the outer case 11 and the inner case 12. The evaporator 14 may be disposed at one side or the rear of the storage compartment. The evaporator 14 may be disposed under the cold air flow path 16. The evaporator 14 may be disposed under the ventilation device 100. The evaporator 14 may be disposed in a lower area of the refrigerator 10. The evaporator 14 may heat-exchange air supplied from the storage compartment with a refrigerant to generate a cold air. The cold air generated by the evaporator 14 may be provided to the ventilation device 100.

The evaporator 14 may include a plurality of evaporators. One of the plurality of evaporators may cool the refrigerator compartment, and the other may cool the freezer compartment. Alternatively, both the refrigerator compartment and the freezer compartment may be cooled by one evaporator.

The refrigerator 10 according to an embodiment of the present disclosure may include a refrigeration cycle device including a compressor (not shown) for compressing the refrigerant, a condenser (not shown) for condensing the refrigerant compressed by the compressor, an expansion mechanism for expanding the refrigerant condensed by the condenser, and the evaporator 14 to which the refrigerant expanded by the expansion mechanism is provided.

The cold air flow path 16 may be disposed between the outer case 11 and the inner case 12. The cold air flow path 16 may be disposed at one side or the rear of the storage compartment. The cold air flow path 16 may extend in an up-down direction or a vertical direction. The cold air flow path 16 may provide a path through which the cold air flows. One side of the cold air flow path 16 may be connected to the ventilation device 100, and the other side may be connected to the storage compartment. The cold air flow path 16 may be disposed on the ventilation device 100. The cold air flow path 16 may be disposed on the evaporator 14.

The ventilation device 100 may be disposed between the outer case 11 and the inner case 12. The ventilation device 100 may be disposed under the cold air flow path 16. The ventilation device 100 may be disposed in a lower area of the cold air flow path 16. The ventilation device 100 may be disposed on the evaporator 14. The ventilation device 100 may flow the cold air generated by the evaporator 14 to the storage compartment through the cold air flow path 16.

Figure 2:
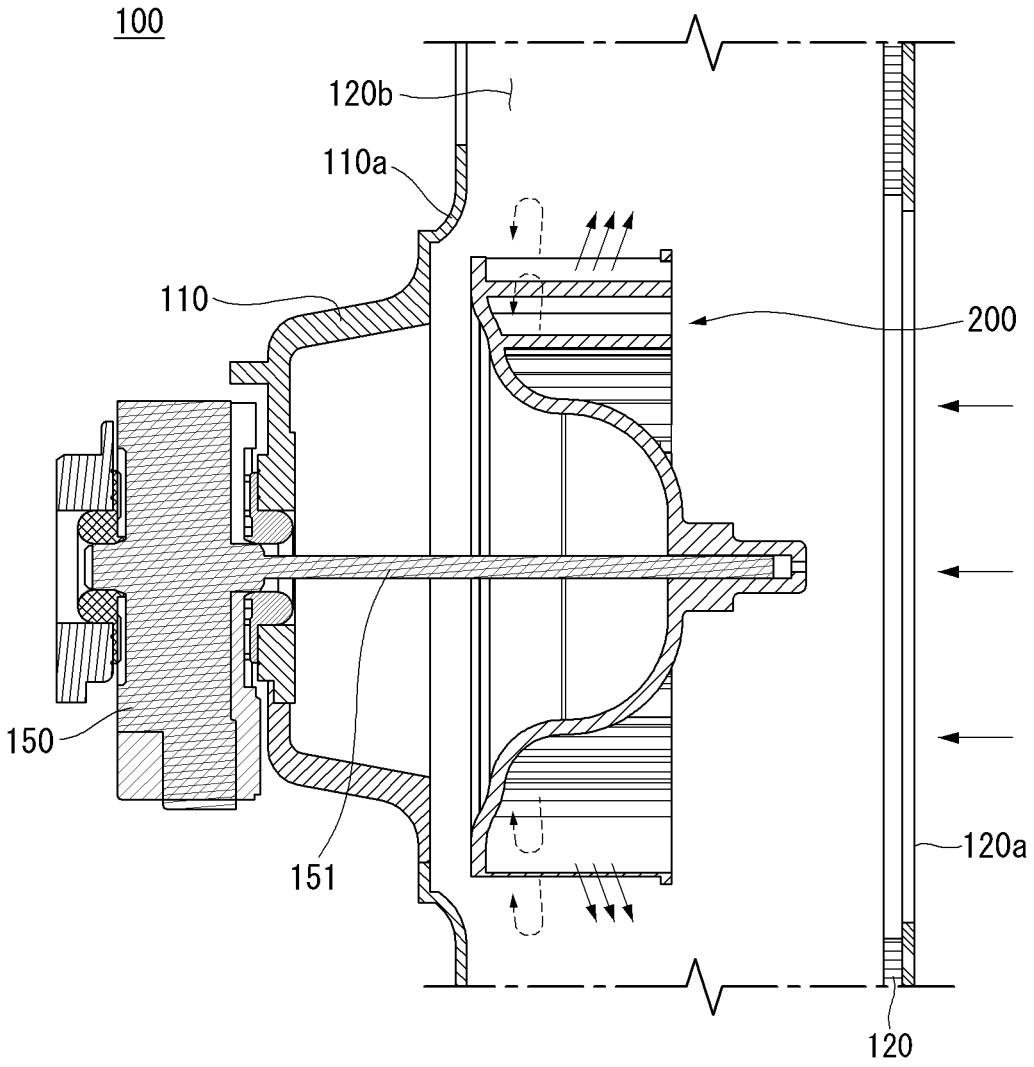
FIG. 2 is a cross-sectional view of a ventilation device according to an embodiment of the present disclosure.

FIG. 2 is a cross-sectional view of a ventilation device according to an embodiment of the present disclosure.

Referring to FIG. 2, the ventilation device 100 according to an embodiment of the present disclosure may include a housing 120, a motor 150, and a fan 200. However, the ventilation device 100 may be implemented including more or less components according to an embodiment.

The housing 120 may include an intake port 120*a* through which cold air generated by the evaporator 14 is sucked, and a discharge port 120*b* for discharging the refrigerant passing through the fan 200. The housing 120 may be fixed to the motor 150. The fan 200 may be rotatably disposed inside the housing 120. The housing 120 may form a flow path for cold air and air.

A bell mouth 110 may extend from the housing 120. The bell mouth 110 may be formed in a central area of the rear of the housing 120. An inner diameter of the bell mouth 110 may increase as it goes toward the fan 200. Further, the ventilation device 100 may include a convex portion 110*a* that is formed between the bell mouth 110 and the housing 120 to be convex toward the fan 200.

The motor 150 may be driven by external power. The motor 150 may be coupled to the housing 120. A rotating shaft 151 of the motor 150 may be coupled to the fan 200. The motor 150 may allow the fan 200 to rotate in one direction according to the rotation of the rotating shaft 151 of the motor 150.

The fan 200 may be disposed in the housing 120. The fan 200 may be rotatably connected to the motor 150. The fan 200 may rotate in one direction according to the rotation of the rotating shaft 151 of the motor 150. The fan 200 may be disposed in front of the motor 150.

Figure 3:
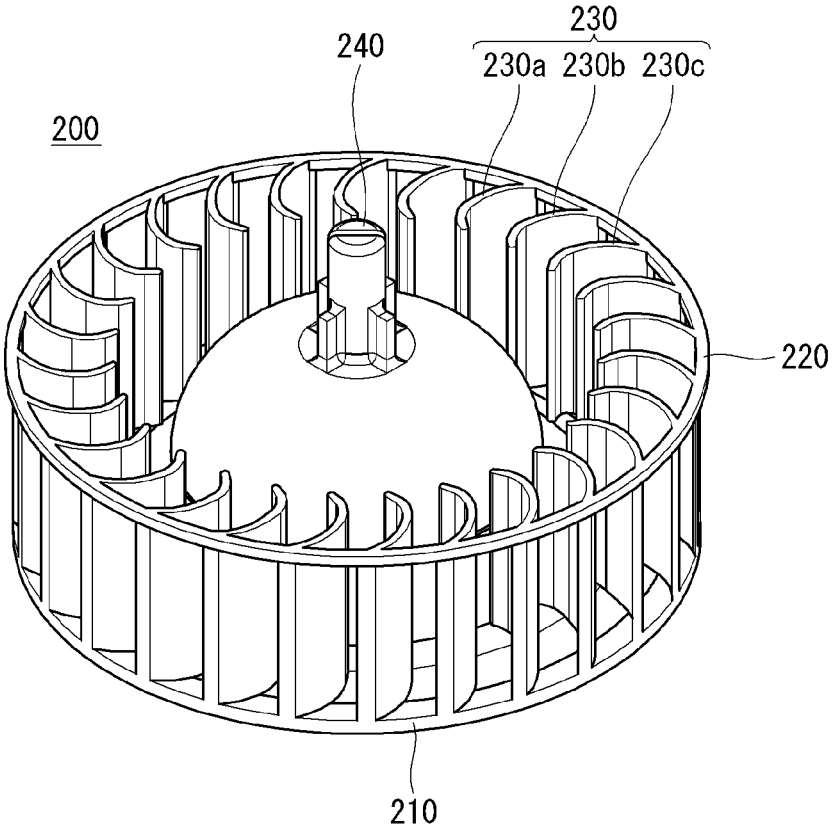
FIG. 3 is a perspective view of a fan according to an embodiment of the present disclosure.
Figure 4:
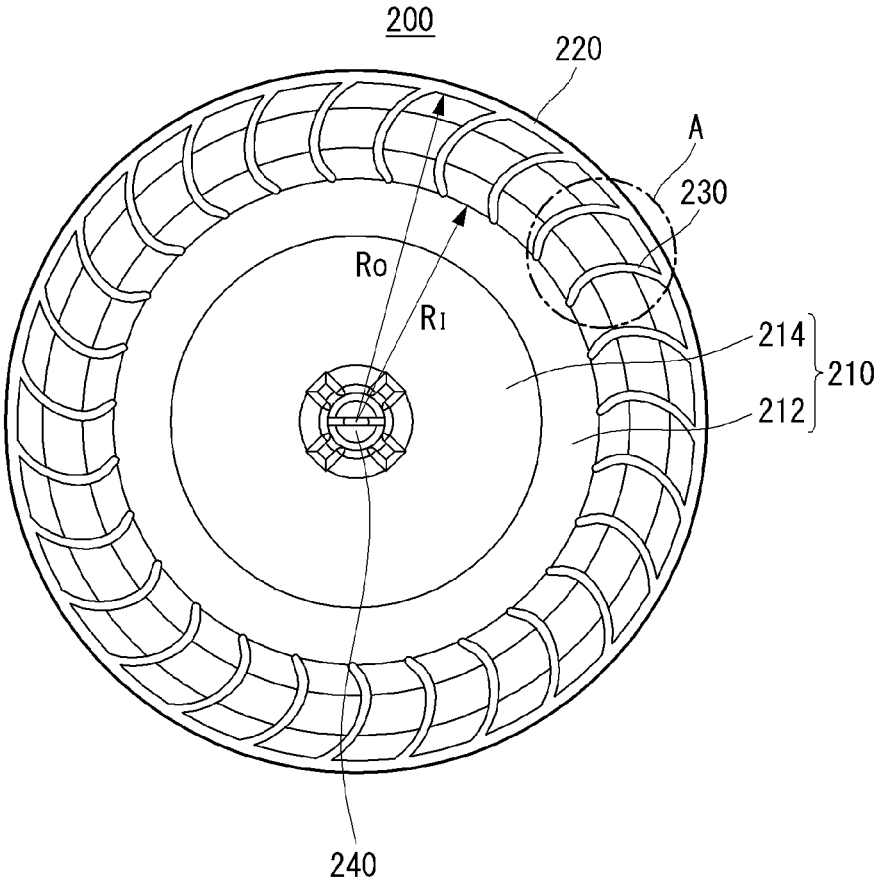
FIG. 4 is a plan view of a fan according to an embodiment of the present disclosure.
Figure 5:
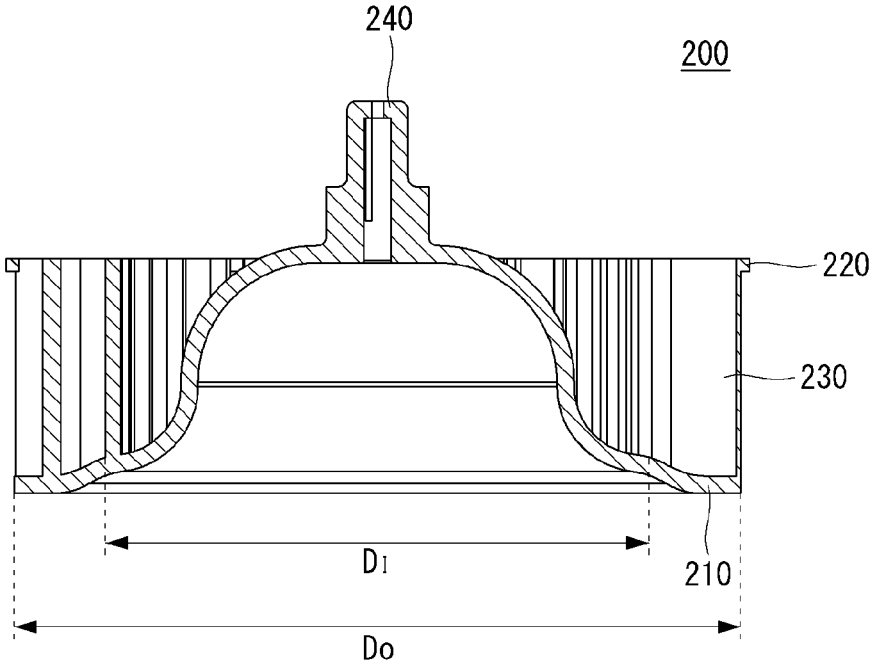
FIG. 5 is a cross-sectional view of a fan according to an embodiment of the present disclosure.
Figure 6:
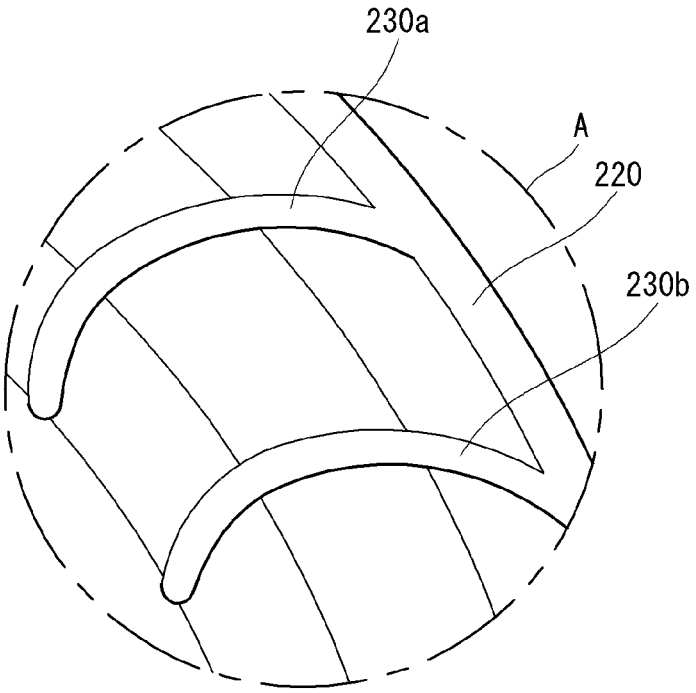
FIG. 6 is an enlarged view of a part A of FIG. 4.
Figure 7:
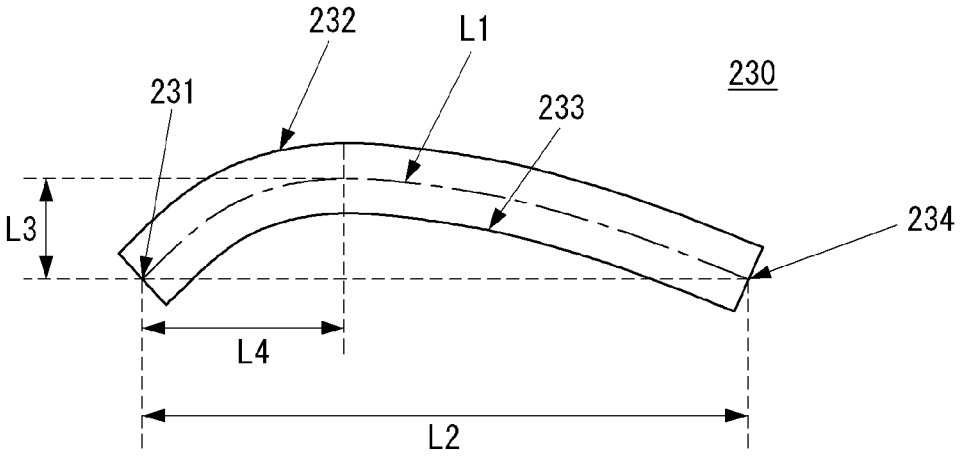
FIG. 7 schematically illustrates a blade according to an embodiment of the present disclosure.

FIG. 3 is a perspective view of a fan according to an embodiment of the present disclosure. FIG. 4 is a plan view of a fan according to an embodiment of the present disclosure. FIG. 5 is a cross-sectional view of a fan according to an embodiment of the present disclosure. FIG. 6 is an enlarged view of a part A of FIG. 4. FIG. 7 schematically illustrates a blade according to an embodiment of the present disclosure.

Referring to FIGS. 3 to 7, the fan 200 according to an embodiment of the present disclosure may include a hub 210, a blade 230, a shroud 220, and a coupling portion 240. However, the fan 200 may be implemented including more or less components according to an embodiment.

The hub 210 may be disposed in the housing 120. The hub 210 may be rotatably coupled to the motor 150. The hub 210 may be coupled to the rotating shaft 151 of the motor 150. The hub 210 may rotate in one direction according to the rotation of the rotating shaft 151 of the motor 150. The blade 230 may be disposed at the hub 210.

The hub 210 may include a first area 212. The blade 230 may be disposed in the first area 212. The blade 230 may be disposed on a front surface of the first area 212. The first area 212 may be formed flat. The first area 212 may be disposed closer to the motor 150 than a second area 214. The first area 212 may be disposed behind the second area 214.

The hub 210 may include the second area 214. The second area 214 may extend from the first area 212. The second area 214 may have curvature. The second area 214 may be formed to be convex in the opposite direction or forward of the motor 150. The second area 214 may be formed in a semicircular shape. The second area 214 may have an infection point. Hence, the hub 210 can improve the intake efficiency of the cold air while guiding the air or refrigerant sucked through the intake port 120*a* toward the blade 230 disposed in the first area 212.

The blade 230 may be disposed at the hub 210. The blade 230 may be disposed in the first area 212 of the hub 210. The blade 230 may be disposed on the front surface of the first area 212 of the hub 210. The blade 230 may be spaced apart from a central area of the hub 210. The blade 230 may have entirely curvature. The blade 230 may have no inflection point. A width of the blade 230 may be constant. Here, the width of the blade 230 may indicate a minimum distance between a pressure surface 233 and a negative pressure surface 232.

The blade 230 may include a leading edge 231 disposed at a radially inner side of the fan 200, a trailing edge 234 disposed at a radially outer side of the fan 200, the pressure surface 233 that connects the leading edge 231 and the trailing edge 234 and is disposed along the rotation direction of the fan 200, and the negative pressure surface 232 that connects the leading edge 231 and the trailing edge 234 and is disposed in the opposite direction of the rotation direction of the fan 200. The pressure surface 233 has a higher pressure than the atmospheric pressure and thus can push out the air. The negative pressure surface 232 is a rear surface of the pressure surface 233 and may have a pressure lower than the atmospheric pressure. The leading edge 231 may contact the cold air introduced through the intake port 120*a*, and the trailing edge 234 may discharge the cold air toward the discharge port 120*b*.

In one embodiment of the present disclosure, a minimum distance between a center of the leading edge 231 and a center of the trailing edge 234 is defined as a chord length L2; a virtual line connecting the center of the leading edge 231 and the center of the trailing edge 234 in a straight line is defined as a chord line; a line connecting midpoints of the pressure surface 233 and the negative pressure surface 232 is defined as a camber line L1; when a virtual line perpendicular to the chord line is connected to the camber line L1, a height at a maximum camber is defined as a maximum camber amount L3; and a distance from the leading edge 231 to the maximum camber is defined as a maximum camber position L4.

The blade 230 may be formed to be entirely concave in the rotation direction. For example, with reference to FIG. 4, when the fan 200 rotates clockwise, the blade 230 may be formed to be concave clockwise or convex counterclockwise. The trailing edge 234 of the blade 230 which is a radially outer end of the fan 200 may be disposed along the rotation direction, as compared to the leading edge 231 which is a radially inner end of the fan 200. For example, with reference to FIG. 4, when the fan 200 rotates clockwise, the trailing edge 234 may be disposed more clockwise or to the right than the leading edge 231.

In this case, since the chord length L2 is shorter than that of a turbofan according to the related art, the number of blades 230*a*, 230*b*, and 230*c* can increase. Hence, the present disclosure can further reduce the number of revolutions of the fan under the same flow rate and discharge pressure conditions, as compared to that of the turbofan according to the related art.

Further, the present disclosure can maintain the fan 200 at the lower number of revolutions than the turbofan according to the related art while increasing the internal capacity of the refrigerator 10.

Accordingly, the present disclosure can reduce noise due to an aerodynamic force or a vibration generated by an increase in the number of revolutions of the fan 200. Further, the present disclosure can increase lifespan of the components of the refrigerator 10, for example, the motor 150 and an oil-impregnated bushing bearing by reducing the number of revolutions of the fan 200.

The blade 230 may include the plurality of blades 230*a*, 230*b*, and 230*c*. The plurality of blades 230*a*, 230*b*, and 230*c* may be disposed radially with respect to the rotating shaft 151 of the motor 150. The plurality of blades 230*a*, 230*b*, and 230*c* may be disposed radially with respect to the central area of the hub 210. The plurality of blades 230*a*, 230*b*, and 230*c* may be spaced apart from each other in a circumferential direction.

The shroud 220 may be coupled to the front surface of the blade 230. The shroud 220 may be coupled to an outer surface or the trailing edge of the blade 230. The shroud 220 may connect the plurality of blades 230. The shroud 220 may be formed in a circular band shape or a ring shape.

The coupling portion 240 may be formed in the hub 210. The coupling portion 240 may be formed in the central area of the hub 210. The coupling portion 240 may be formed in a central portion of the second area 214 of the hub 210. The coupling portion 240 may be coupled to the rotating shaft 151 of the motor 150.

Figure 8:
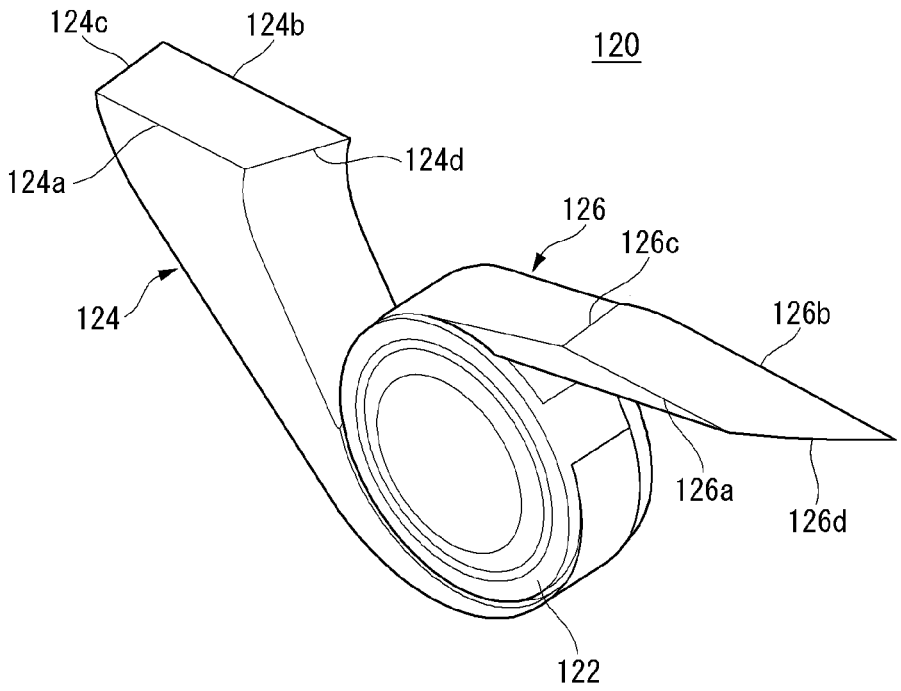
FIG. 8 is a perspective view illustrating a scroll guide and a duct according to an embodiment of the present disclosure.
Figure 9:
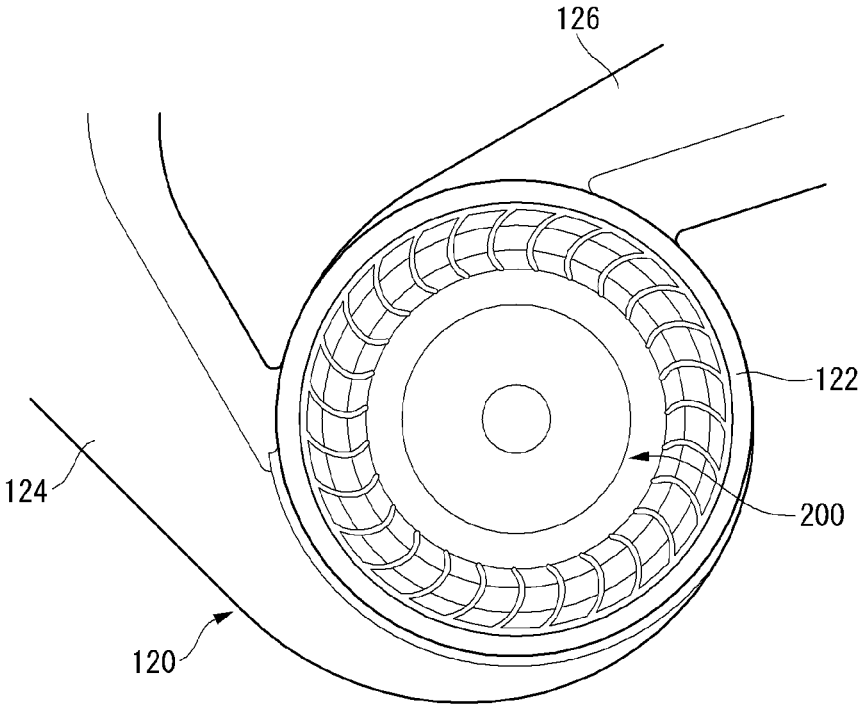
FIG. 9 is a cross-sectional view illustrating a scroll guide, a duct, and a fan according to an embodiment of the present disclosure.
Figure 10:
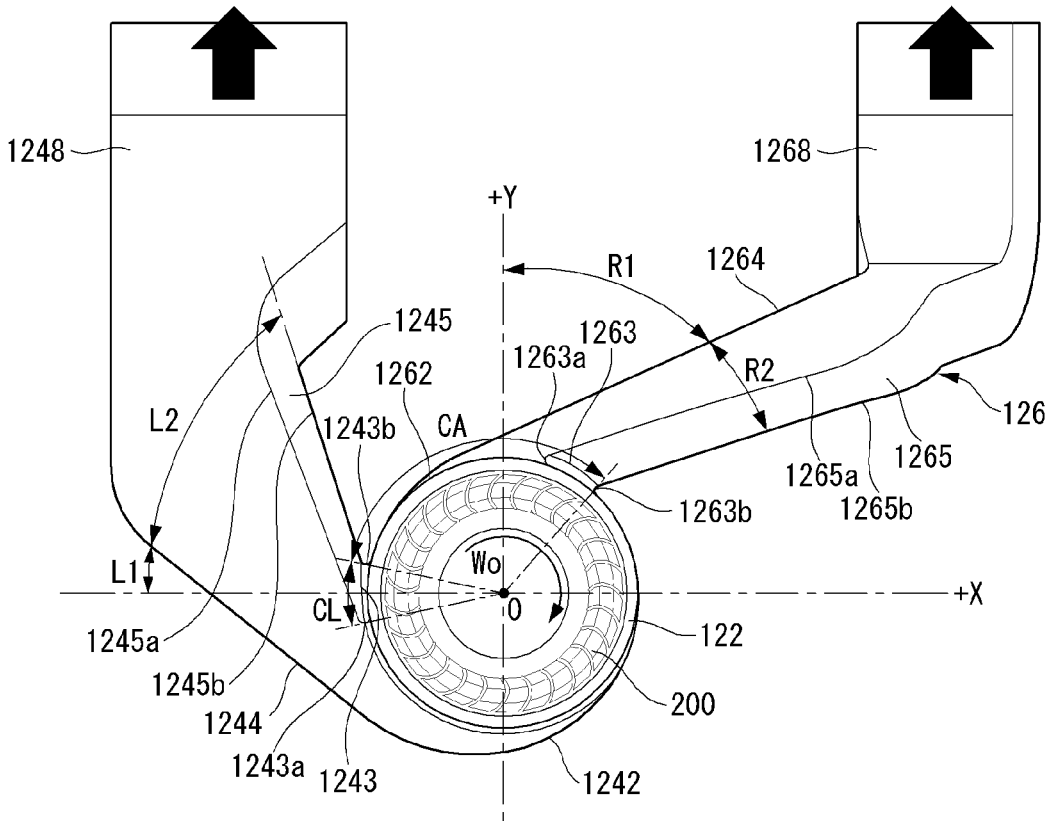
FIG. 10 illustrates operation of a scroll guide, a duct, and a fan according to an embodiment of the present disclosure.
Figure 11:
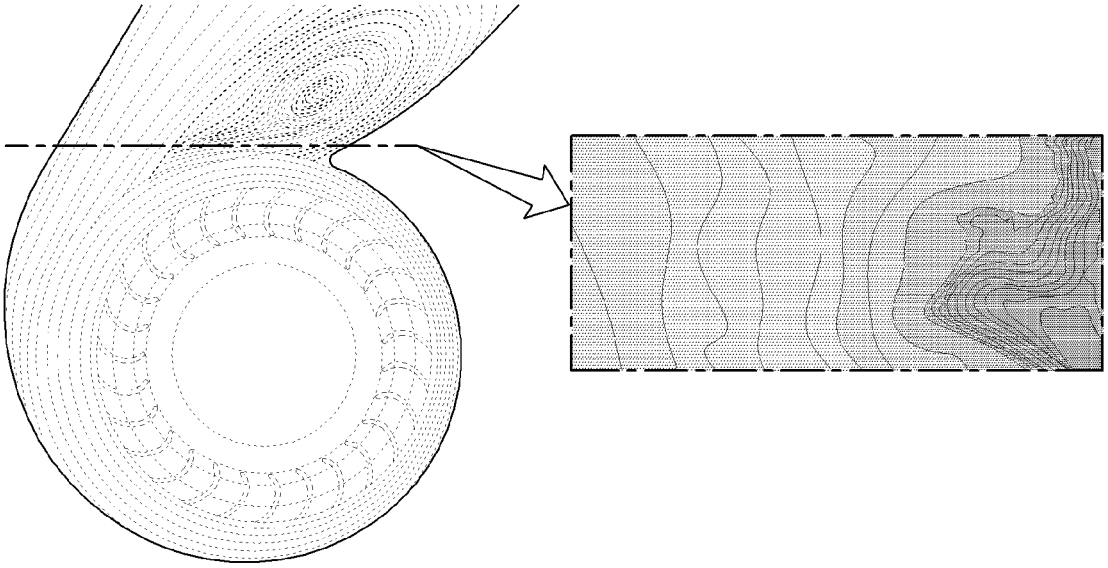
FIG. 11 illustrates a flow of a cold air in a scroll guide and a duct according to a related art.
Figure 12:
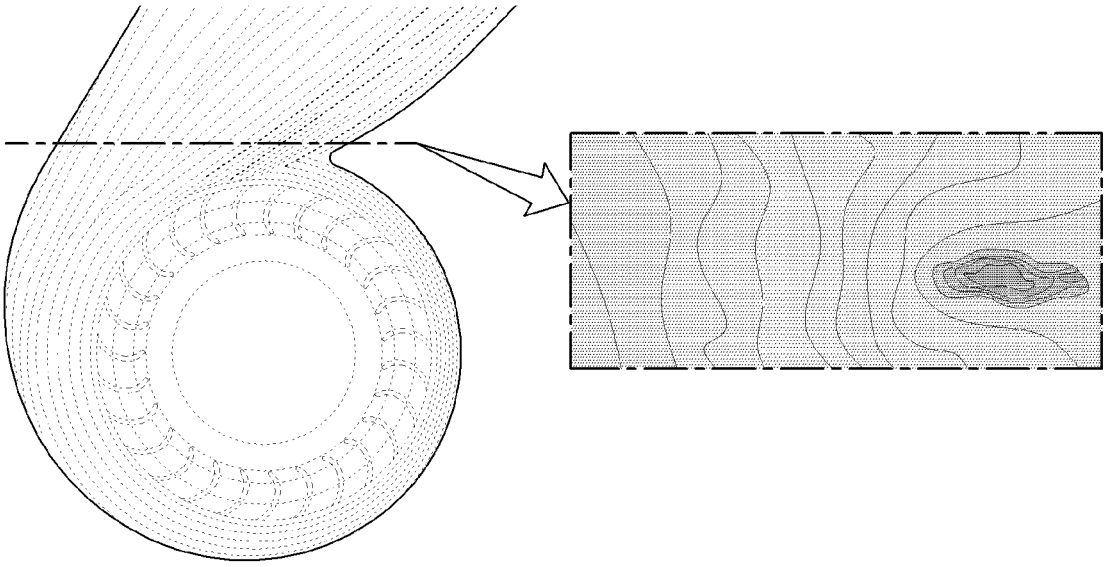
FIG. 12 illustrates a flow of a cold air in a scroll guide and a duct according to an embodiment of the present disclosure.

FIG. 8 is a perspective view illustrating a scroll guide and a duct according to an embodiment of the present disclosure. FIG. 9 is a cross-sectional view illustrating a scroll guide, a duct, and a fan according to an embodiment of the present disclosure. FIG. 10 illustrates operation of a scroll guide, a duct, and a fan according to an embodiment of the present disclosure. FIG. 11 illustrates a flow of a cold air in a scroll guide and a duct according to a related art. FIG. 12 illustrates a flow of a cold air in a scroll guide and a duct according to an embodiment of the present disclosure. FIGS. 13 to 18 are graphs illustrating a minimum shaft power depending on a shape of a duct according to an embodiment of the present disclosure.

Referring to FIGS. 8 to 10, the housing 120 may include a scroll guide 122, a first duct 124, and a second duct 126. However, the housing 120 may be implemented including more or less components according to an embodiment.

The fan 200 may be disposed inside the scroll guide 122. The scroll guide 122 may guide the cold air discharged from the fan 200 in both directions. An inner surface of the scroll guide 122 may be spaced apart from the fan 200. A separation distance between the scroll guide 122 and the fan 200 may be constant. Through this, it is possible to reduce vibration or noise generated due to an irregular separation distance between the scroll guide 122 and the fan 200. The scroll guide 122 may be connected to the first duct 124 and the second duct 126. The first duct 124 may be connected below the scroll guide 122, and the second duct 126 may be connected above the scroll guide 122. The scroll guide 122 may guide the cold air discharged from the fan 200 to the first duct 124 and the second duct 126.

The ducts 124 and 126 may extend from the scroll guide 122 and extend along the rotation direction of the fan 200. An embodiment of the present disclosure describes a double scroll structure in which the two ducts 124 and 126 are formed, by way of example.

Cross-sectional areas of the first duct 124 and the second duct 126 may increase as they become far away from the fan 200. Hence, this can prevent the cold air from flowing backward and can allow the cold air to flow smoothly in the duct.

The first duct 124 may extend from the bottom toward an upper left end of the fan 200. The first duct 124 may extend from a lower part of the scroll guide 122 in a rotation direction Wo of the fan 200. The first duct 124 may include a first shroud-side surface 124*a*, a first hub-side surface 124*b*, a first surface 124*c*, and a second surface 124*d*.

A length of the first hub-side surface 124*b* may be formed to be greater than a length of the first shroud-side surface 124*a*. Specifically, referring to FIG. 8, a horizontal length of the first hub-side surface 124*b* may be greater than a horizontal length of the first shroud-side surface 124*a* on the same plane. That is, a cross-section of the first duct 124 may be formed in a trapezoidal shape.

The first surface 124*c* may connect the first hub-side surface 124*b* and the first shroud-side surface 124*a*. The first surface 124*c* may be positioned in a direction opposite to the rotation direction Wo of the fan 200, as compared to the second surface 124*d*.

The first surface 124*c* and the second surface 124*d* may form a predetermined angle. Specifically, the first surface 124*c* and the second surface 124*d* may not be parallel to each other.

When viewed from the front of the refrigerator 10, the first surface 124*c* may include a first curved portion 1242 extending from the scroll guide 122 and a first straight portion 1244 extending from the first curved portion 1242. Through this, the smooth flow of cold air from the fan 200 to the first duct 124 is enabled.

The second surface 124*d* may connect the first hub-side surface 124*b* and the first shroud-side surface 124*a*. The second surface 124*d* may be disposed along the rotation direction Wo of the fan 200, as compared to the first surface 124*c*.

The second surface 124*d* may include a second straight portion 1245 extending from the scroll guide 122.

A straight line passing through a shroud-side cutoff point 1243*a* of the second surface 124*d* and the center O of the fan 200 and a straight line passing through a hub-side cutoff point 1243*b* of the second surface 124*d* and the center O of the fan 200 may have a predetermined angle CL.

Referring to FIG. 10, in the related art, if a straight line passing through a shroud-side cutoff point 1243*a* of a second surface 124*d* and the center O of a fan 200 and a straight line passing through a hub-side cutoff point 1243*b* of the second surface 124*d* and the center O of the fan 200 do not have a predetermined angle, it can be seen that a vortex occurs in an area connecting the shroud-side cutoff point 1243*a* of the second surface 124*d* and the hub-side cutoff point 1243*b* of the second surface 124*d*.

Referring to FIG. 11, in the ventilation device 100 according to an embodiment of the present disclosure, since the straight line passing through the shroud-side cutoff point 1243*a* of the second surface 124*d* and the center O of the fan 200 and the straight line passing through the hub-side cutoff point 1243*b* of the second surface 124*d* and the center O of the fan 200 have the predetermined angle CL, a refrigerant having a relatively high discharge speed as passing through the hub 210 of the fan 200 is first introduced into the first duct 124, and a refrigerant having a relatively low discharge speed as passing through the shroud 220 of the fan 200 is then introduced into the first duct 124. Hence, a vortex can be prevented from occurring in an area connecting the shroud-side cutoff point 1243*a* of the second surface 124*d* and the hub-side cutoff point 1243*b* of the second surface 124*d*. Further, the efficiency of the ventilation device 100 can be improved by preventing the reverse flow of cold air.

Figure 13:
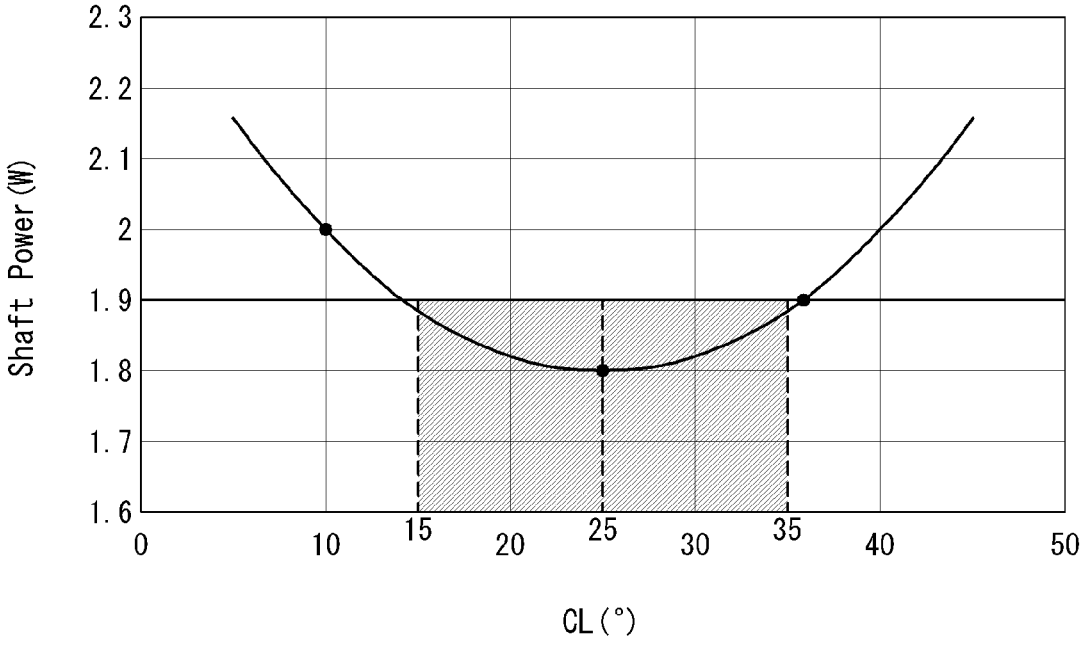
FIGS. 13 to 18 are graphs illustrating a minimum shaft power depending on a shape of a duct according to an embodiment of the present disclosure.

The angle CL between the straight line passing through the shroud-side cutoff point 1243*a* of the second surface 124*d* and the center O of the fan 200 and the straight line passing through the hub-side cutoff point 1243*b* of the second surface 124*d* and the center O of the fan 200 may be 15° to 35°. Referring to FIG. 13, when the angle CL between the straight line passing through the shroud-side cutoff point 1243*a* of the second surface 124*d* and the center O of the fan 200 and the straight line passing through the hub-side cutoff point 1243*b* of the second surface 124*d* and the center O of the fan 200 is 25°, the required shaft power of the ventilation device 100 is minimized. That is, when the angle CL between the straight line passing through the shroud-side cutoff point 1243*a* of the second surface 124*d* and the center O of the fan 200 and the straight line passing through the hub-side cutoff point 1243*b* of the second surface 124*d* and the center O of the fan 200 is 15° to 35°, the required shaft power is minimized as compared to other areas. Therefore, the present disclosure can reduce the number of revolutions of the fan 200 and also reduce the size of the ventilation device 100.

Figure 14:
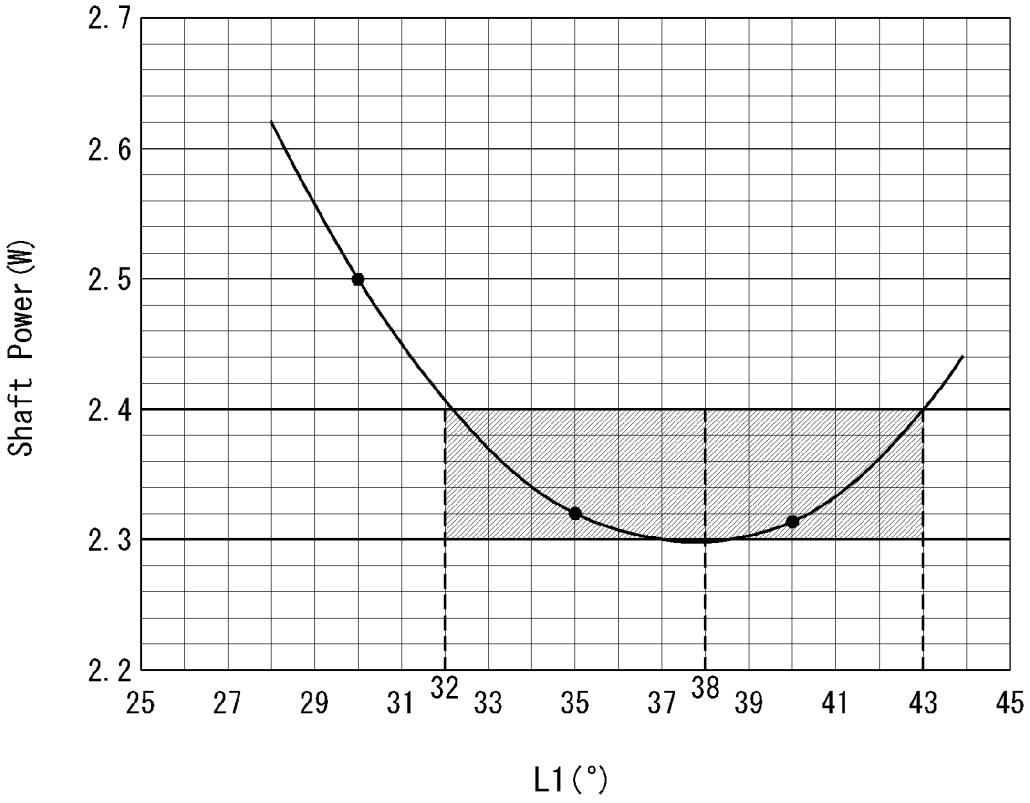

An angle L1 between the first straight portion 1244 and a line X extending in the horizontal direction from the center O of the fan 200 may be 32° to 43°. Referring to FIG. 14, when the angle L1 between the first straight portion 1244 and the line X extending in the horizontal direction from the center O of the fan 200 is 38°, the required shaft power of the ventilation device 100 is minimized. That is, when the angle L1 between the first straight portion 1244 and the line X extending in the horizontal direction from the center O of the fan 200 is 32° to 43° the required shaft power is minimized as compared to other areas. Therefore, the present disclosure can reduce the number of revolutions of the fan 200 and also reduce the size of the ventilation device 100.

Figure 15:
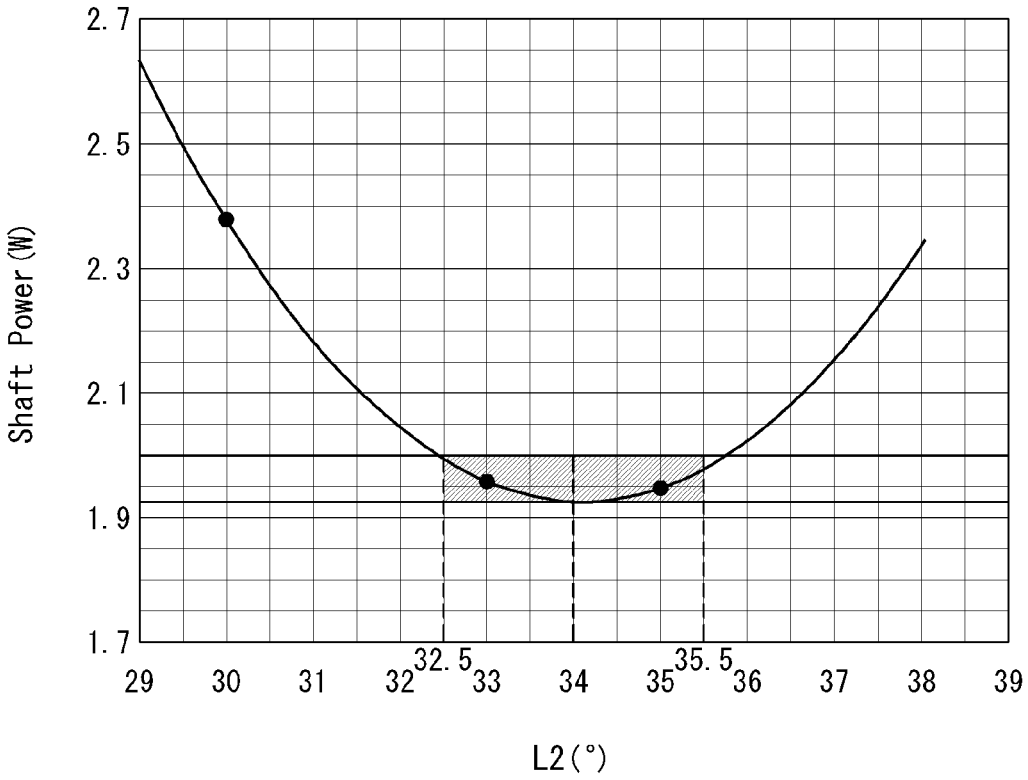

An angle L2 between the first straight portion 1244 and a hub-side line 1245*b* of the second straight portion 1245 may be 32.5° to 35.5°. Referring to FIG. 15, when the angle L2 between the first straight portion 1244 and the hub-side line 1245*b* of the second straight portion 1245 is 34° the required shaft power of the ventilation device 100 is minimized. That is, when the angle L2 between the first straight portion 1244 and the hub-side line 1245*b* of the second straight portion 1245 is 32.5° to 35.5°, the required shaft power is minimized as compared to other areas. Therefore, the present disclosure can reduce the number of revolutions of the fan 200 and also reduce the size of the ventilation device 100.

The second duct 126 may extend from the top toward an upper right end of the fan 200. The second duct 126 may extend from an upper part of the scroll guide 122 in the rotation direction Wo of the fan 200. The second duct 126 may include a second shroud-side surface 126*a*, a second hub-side surface 126*b*, a third surface 126*c*, and a fourth surface 126*d*.

A length of the second hub-side surface 126*b* may be formed to be greater than a length of the second shroud-side surface 126*a*. Specifically, referring to FIG. 8, a horizontal length of the second hub-side surface 126*b* may be greater than a horizontal length of the second shroud-side surface 126*a* on the same plane. That is, a cross-section of the second duct 126 may be formed in a trapezoidal shape.

The third surface 126*c* may connect the second hub-side surface 126*b* and the second shroud-side surface 126*a*. The third surface 126*c* may be positioned in a direction opposite to the rotation direction Wo of the fan 200, as compared to the fourth surface 126*d*.

The third surface 126*c* may include a second curved portion 1262 extending from the scroll guide 122 and a third straight portion 1264 extending from the second curved portion 1262.

The fourth surface 126*d* may connect the second hub-side surface 126*b* and the second shroud-side surface 126*a*. The fourth surface 126*d* may be disposed along the rotation direction Wo of the fan 200, as compared to the third surface 126*c*.

The third surface 126*c* and the fourth surface 126*d* may form a predetermined angle. Specifically, the third surface 126*c* and the fourth surface 126*d* may not be parallel to each other.

A straight line passing through a shroud-side cutoff point 1263*a* of the fourth surface 126*d* and the center O of the fan 200 and a straight line passing through a hub-side cutoff point 1263*b* of the fourth surface 126*d* and the center O of the fan 200 may have a predetermined angle.

Referring to FIG. 10, in the related art, if a straight line passing through a shroud-side cutoff point 1263*a* of a fourth surface 126*d* and the center O of the fan 200 and a straight line passing through a hub-side cutoff point 1263*b* of the fourth surface 126*d* and the center O of the fan 200 do not have a predetermined angle, it can be seen that a vortex occurs in an area connecting the shroud-side cutoff point 1263*a* of the fourth surface 126*d* and the hub-side cutoff point 1263*b* of the fourth surface 126*d*.

Referring to FIG. 11, in the ventilation device 100 according to an embodiment of the present disclosure, since the straight line passing through the shroud-side cutoff point 1263*a* of the fourth surface 126*d* and the center O of the fan 200 and the straight line passing through the hub-side cutoff point 1263*b* of the fourth surface 126*d* and the center O of the fan 200 have the predetermined angle CL, a refrigerant having a relatively high discharge speed as passing through the hub 210 of the fan 200 is first introduced into the second duct 126, and a refrigerant having a relatively low discharge speed as passing through the shroud 220 of the fan 200 is then introduced into the second duct 126. Hence, a vortex can be prevented from occurring in an area connecting the shroud-side cutoff point 1263*a* of the fourth surface 126*d* and the hub-side cutoff point 1263*b* of the fourth surface 126*d*. Further, the efficiency of the ventilation device 100 can be improved by preventing the reverse flow of cold air.

The fourth surface 126*d* may include a fourth straight portion 1265 extending from the scroll guide 122.

Figure 16:
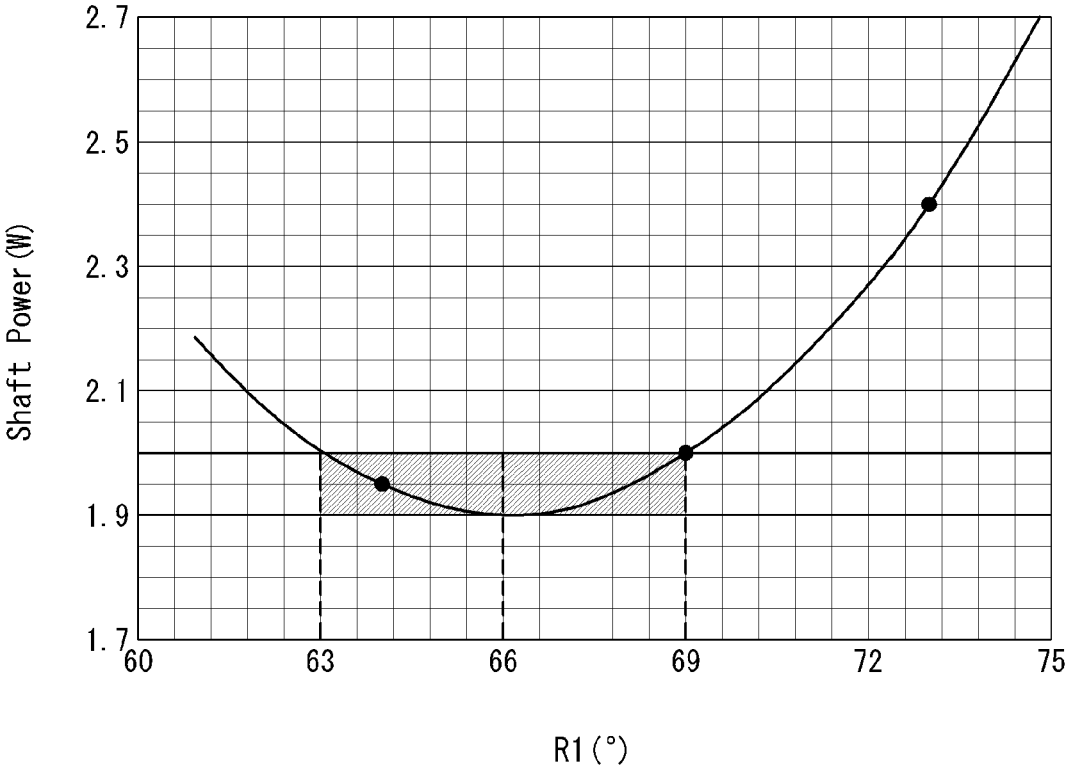

An angle R1 between the third straight portion 1264 and a line Y extending in the vertical direction from the center O of the fan 200 may be 63° to 69°. Referring to FIG. 16, when the angle R1 between the third straight portion 1264 and the line Y extending in the vertical direction from the center O of the fan 200 is 66°, the required shaft power of the ventilation device 100 is minimized. That is, when the angle R1 between the third straight portion 1264 and the line Y extending in the vertical direction from the center O of the fan 200 is 63° to 69°, the required shaft power is minimized as compared to other areas. Therefore, the present disclosure can reduce the number of revolutions of the fan 200 and also reduce the size of the ventilation device 100.

Figure 17:
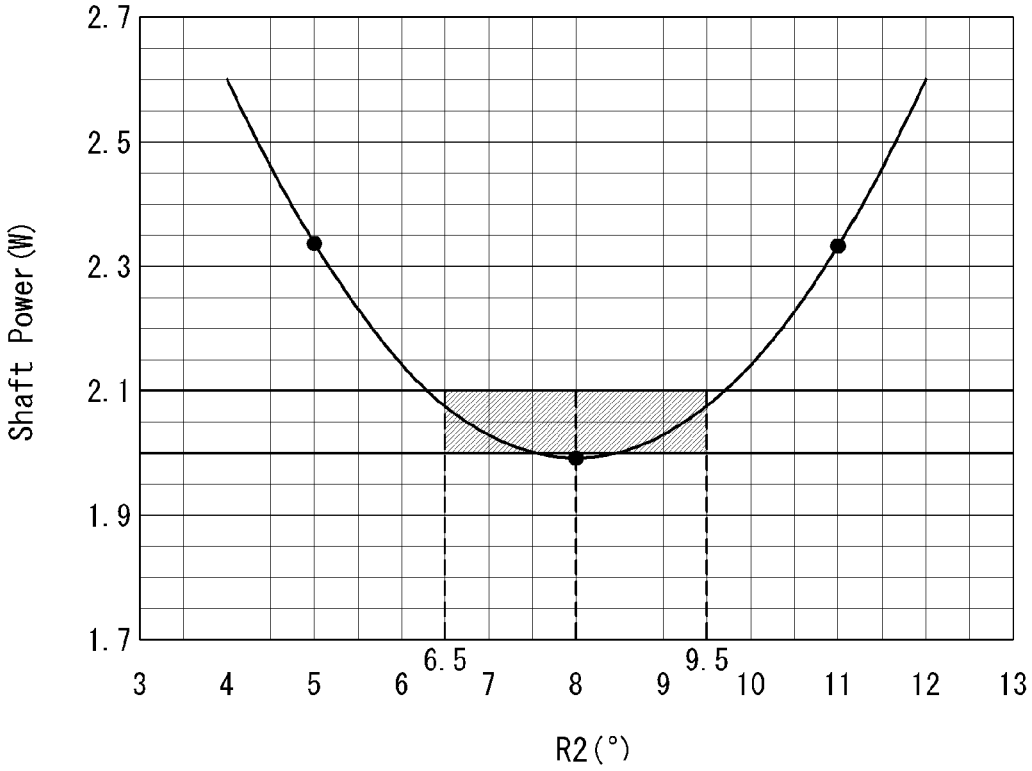

An angle R2 between the third straight portion 1264 and a hub-side line 1265*b* of the fourth straight portion 1265 may be 6.5° to 9.5°. Referring to FIG. 17, when the angle R2 between the third straight portion 1264 and the hub-side line 1265*b* of the fourth straight portion 1265 is 8° the required shaft power of the ventilation device 100 is minimized. That is, when the angle R2 between the third straight portion 1264 and the hub-side line 1265*b* of the fourth straight portion 1265 is 6.5° to 9.5°, the required shaft power is minimized as compared to other areas. Therefore, the present disclosure can reduce the number of revolutions of the fan 200 and also reduce the size of the ventilation device 100.

Figure 18:
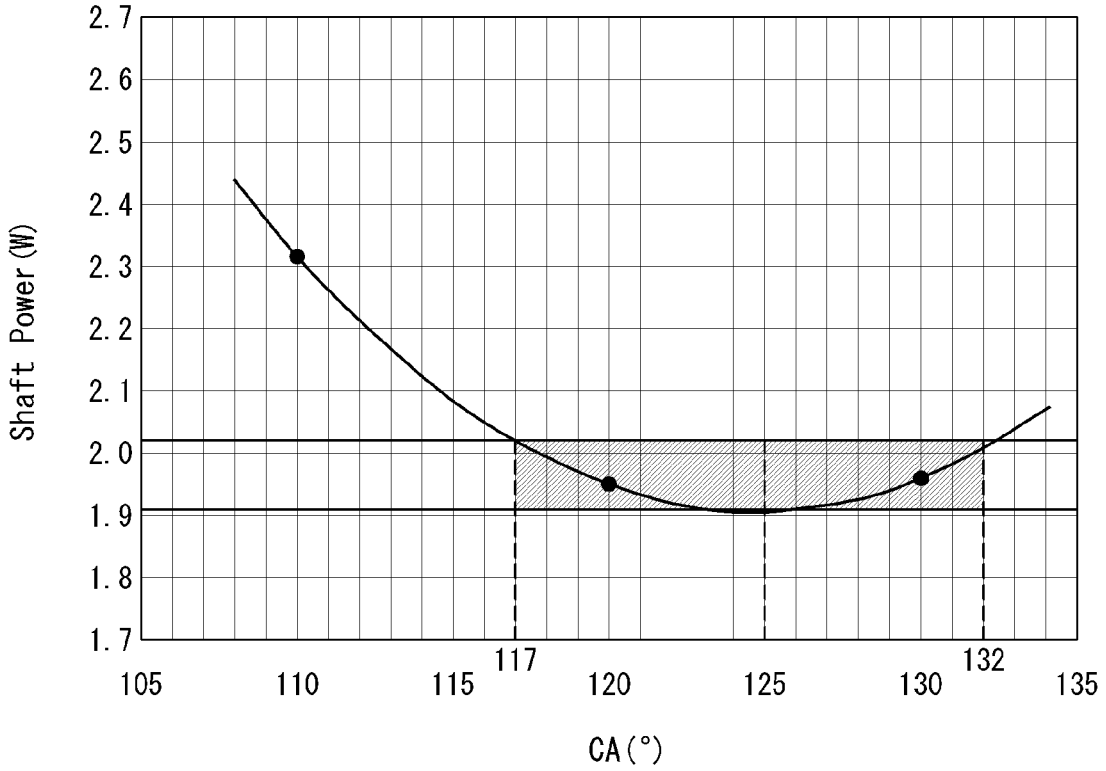

An angle CA between a straight line connecting the hub-side cutoff point 1243*b* of the second surface 124*d* and the center O of the fan 200 and a straight line connecting the hub-side cutoff point 1263*b* of the fourth surface 126*d* and the center O of the fan 200 may be 117° to 132°. Referring to FIG. 18, when the angle CA between the straight line connecting the hub-side cutoff point 1243*b* of the second surface 124*d* and the center O of the fan 200 and the straight line connecting the hub-side cutoff point 1263*b* of the fourth surface 126*d* and the center O of the fan 200 is 125°, the required shaft power of the ventilation device 100 is minimized. That is, when the angle CA between the straight line connecting the hub-side cutoff point 1243*b* of the second surface 124*d* and the center O of the fan 200 and the straight line connecting the hub-side cutoff point 1263*b* of the fourth surface 126*d* and the center O of the fan 200 is 117° to 132° the required shaft power is minimized as compared to other areas. Therefore, the present disclosure can reduce the number of revolutions of the fan 200 and also reduce the size of the ventilation device 100.

Figure 19:
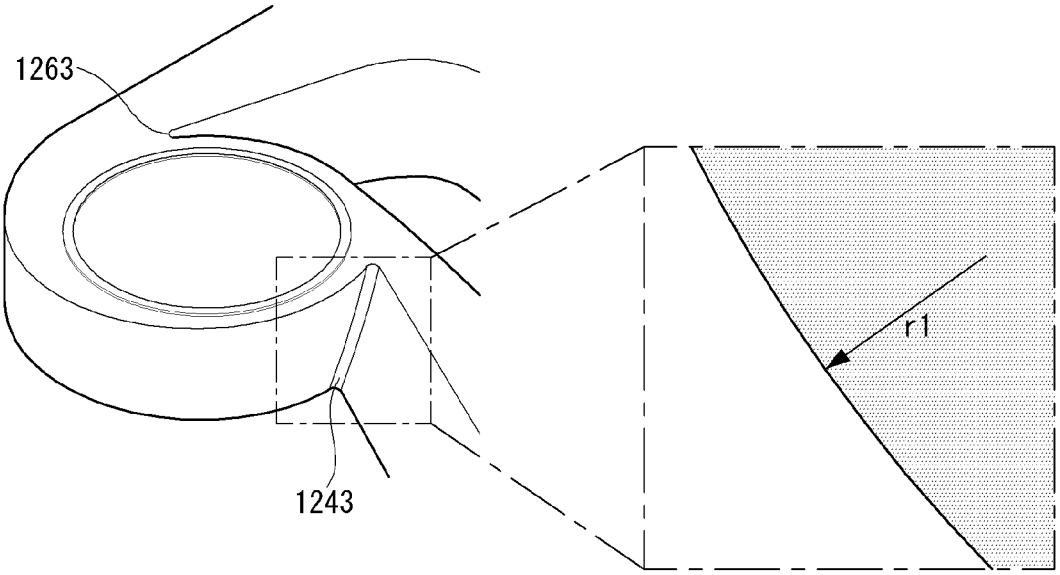
FIGS. 19 to 21 illustrate a line connecting cutoff points of a duct according to an embodiment of the present disclosure.
Figure 20:
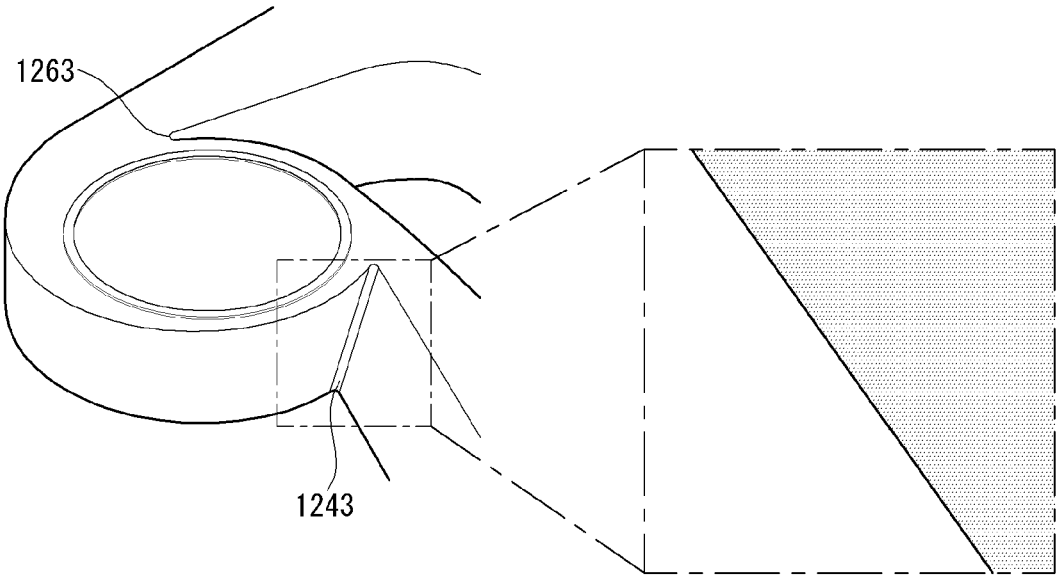
Figure 21:
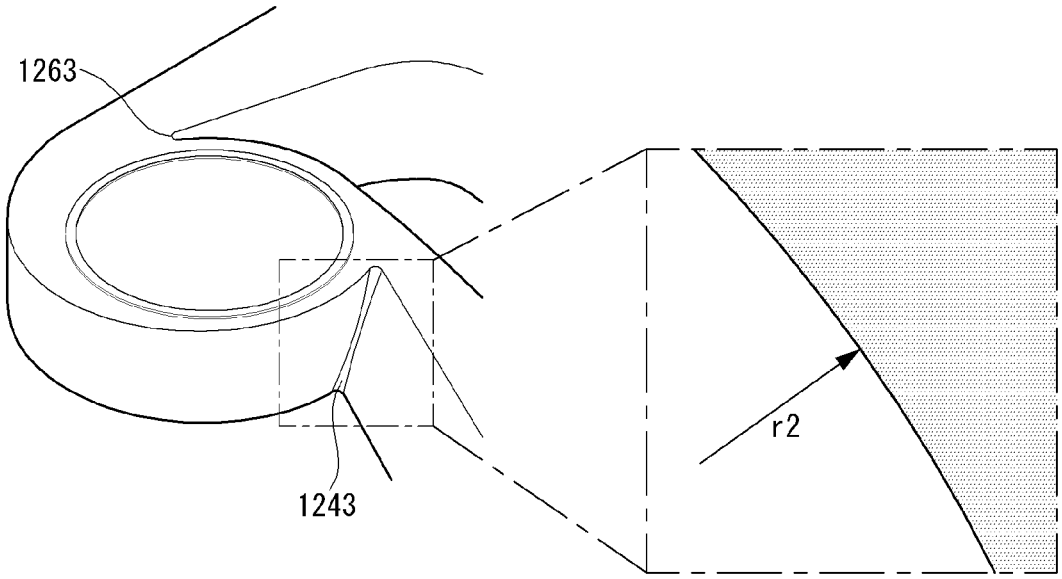
Figure 22:
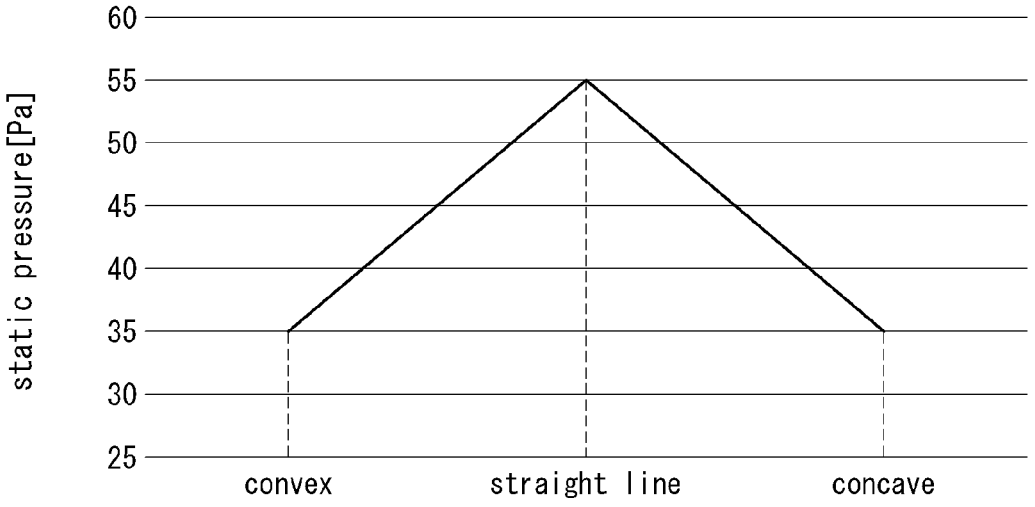
FIG. 22 is a graph illustrating a static pressure depending on a shape of a line connecting cutoff points of a duct according to an embodiment of the present disclosure.

FIGS. 19 to 21 illustrate a line connecting cutoff points of a duct according to an embodiment of the present disclosure. FIG. 22 is a graph illustrating a static pressure depending on a shape of a line connecting cutoff points of a duct according to an embodiment of the present disclosure.

Referring to FIG. 19, lines 1243 and 1263 connecting the shroud-side cutoff points 1243*a* and 1263*a* and the hub-side cutoff points 1243*b* and 1263*b* of the first and second ducts 124 and 126 may be formed to be convex in the radially outward direction of the fan 200.

Referring to FIG. 20, the lines 1243 and 1263 connecting the shroud-side cutoff points 1243*a* and 1263*a* and the hub-side cutoff points 1243*b* and 1263*b* of the first and second ducts 124 and 126 may be formed as a straight line.

Referring to FIG. 21, the lines 1243 and 1263 connecting the shroud-side cutoff points 1243*a* and 1263*a* and the hub-side cutoff points 1243*b* and 1263*b* of the first and second ducts 124 and 126 may be formed to be concave in the radially inward direction of the fan 200.

Referring to FIG. 22, static pressure rise efficiency when the lines 1243 and 1263 connecting the shroud-side cutoff points 1243*a* and 1263*a* and the hub-side cutoff points 1243*b* and 1263*b* of the first and second ducts 124 and 126 are formed as a straight line can further increase as compared to static pressure rise efficiency when the lines 1243 and 1263 connecting the shroud-side cutoff points 1243*a* and 1263*a* and the hub-side cutoff points 1243*b* and 1263*b* of the first and second ducts 124 and 126 are formed to be convex or concave.

That is, as the lines 1243 and 1263 connecting the shroud-side cutoff points 1243*a* and 1263*a* and the hub-side cutoff points 1243*b* and 1263*b* of the first and second ducts 124 and 126 are formed as a straight line, the present disclosure can reduce the generation of vortex around the cutoff points and prevent the cold air from flowing backward by increasing the static pressure rise efficiency.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A ventilation device comprising:

a fan comprising:

a hub coupled to a rotating shaft, a plurality of blades disposed at the hub and radially spaced apart from the rotating shaft, and a shroud that is spaced apart from the hub in an axial direction of the rotating shaft and connects the plurality of blades;

a scroll guide configured to guide air discharged from the fan in a plurality of directions;

a first duct that extends from a first portion of the scroll guide along a rotation direction of the fan; and a second duct that extends from a second portion of the scroll guide along the rotation direction of the fan, the second duct comprising a second hub-side surface and a second shroud-side surface, wherein the first duct comprises:

a first hub-side surface, a first shroud-side surface, a first surface that connects the first hub-side surface to the first shroud-side surface, and a second surface that connects the first hub-side surface to the first shroud-side surface and that is disposed at a position forward relative to the first surface in the rotation direction of the fan, the second surface having a shroud-side cutoff point and a hub-side cutoff point, wherein the first surface and the second surface define a predetermined angle, wherein an angle between (i) a straight line extending from a center of the fan to the shroud-side cutoff point of the second surface and (ii) a straight line extending from the center of the fan to the hub-side cutoff point of the second surface is 15° to 35°, wherein a length of the first hub-side surface is greater than a length of the first shroud-side surface, and wherein a length of the second hub-side surface is greater than a length of the second shroud-side surface.

2. The ventilation device of claim 1, wherein the first duct further comprises:

a first curved portion that extends from the scroll guide;

a first straight portion that extends from the first curved portion to the first surface; and a second straight portion that extends from the scroll guide to the second surface.

3. The ventilation device of claim 2, wherein the first straight portion is inclined with respect to a line extending in a horizontal direction from the center of the fan, and wherein an angle between the first straight portion and the line extending in the horizontal direction is 32° to 43°.

4. The ventilation device of claim 2, wherein the first straight portion is inclined with respect to the second straight portion, and wherein an angle between the first straight portion and the second straight portion is 32.5° to 35.5°.

5. The ventilation device of claim 1, wherein the second duct further comprises:

a third surface that connects the second hub-side surface to the second shroud-side surface; and a fourth surface that connects the second hub-side surface to the second shroud-side surface, the fourth surface being disposed at a position forward relative to the third surface in the rotation direction of the fan, and wherein the third surface and the fourth surface of the second duct define a predetermined angle in a same plane.

6. The ventilation device of claim 5, wherein the fourth surface of the second duct has a shroud-side cutoff point and a hub-side cutoff point, and wherein the predetermined angle is defined between (i) a straight line extending from the center of the fan to the shroud-side cutoff point of the fourth surface of the second duct and (ii) the straight line extending from the center of the fan to the hub-side cutoff point of the fourth surface of the second duct.

7. The ventilation device of claim 5, wherein the second duct further comprises:

a second curved portion that extends from the scroll guide;

a third straight portion that extends from the second curved portion to the third surface of the second duct; and a fourth straight portion that extends from the scroll guide to the fourth surface of the second duct.

8. The ventilation device of claim 7, wherein the third straight portion of the second duct is inclined with respect to a line extending in a vertical direction from the center of the fan, and wherein an angle between the third straight portion of the second duct and the line extending in the vertical direction is 63° to 69°.

9. The ventilation device of claim 7, wherein the third straight portion of the second duct is inclined with respect to the fourth straight portion of the second duct, and wherein an angle between the third straight portion of the second duct and the fourth straight portion of the second duct is 6.5° to 9.5°.

10. The ventilation device of claim 1, wherein the second duct comprises:

a third surface that connects the second hub-side surface to the second shroud-side surface, and a fourth surface that connects the second hub-side surface to the second shroud-side surface, the fourth surface being disposed at a position forward relative to the third surface in the rotation direction of the fan, wherein each of the second surface and the fourth surface has a hub-side cutoff point, and wherein an angle between (i) a straight line extending from the center of the fan to the hub-side cutoff point of the second surface and (ii) a straight line extending from the center of the fan to the hub-side cutoff point of the fourth surface is 117° to 132°.

11. The ventilation device of claim 1, wherein the first duct extends in a downward direction from the scroll guide, and the second duct extends in an upward direction from the scroll guide.

12. The ventilation device of claim 1, wherein the second duct comprises:

a shroud-side cutoff point; and a hub-side cutoff point, wherein a line connecting the shroud-side cutoff point of the first duct to the hub-side cutoff point of the first duct is straight, and wherein a line connecting the shroud-side cutoff point of the second duct to the hub-side cutoff point of the second duct is straight.

13. The ventilation device of claim 1, wherein the scroll guide is spaced apart from the fan by a predetermined distance along a circumference of the fan.

14. The ventilation device of claim 1, wherein a cross-sectional area of the first duct increases as the first duct extends away from the fan, and wherein a cross-sectional area of the second duct increases as the second duct extends away from the fan.

15. The ventilation device of claim 1, wherein each of the plurality of blades is concave in the rotation direction of the fan.

16. A ventilation device comprising:

a fan comprising:

a hub coupled to a rotating shaft, a plurality of blades disposed at the hub and radially spaced apart from the rotating shaft, and a shroud that is spaced apart from the hub in an axial direction of the rotating shaft and connects the plurality of blades;

a scroll guide configured to guide air discharged from the fan in a plurality of directions;

a first duct that extends from a first portion of the scroll guide along a rotation direction of the fan, wherein a cross-sectional area of the first duct increases as the first duct extends away from the fan; and a second duct that extends from a second portion of the scroll guide along the rotation direction of the fan, wherein a cross-sectional area of the second duct increases as the second duct extends away from the fan, wherein the first duct comprises:

a first hub-side surface, a first shroud-side surface, a first surface that connects the first hub-side surface to the first shroud-side surface, and a second surface that connects the first hub-side surface to the first shroud-side surface and that is disposed at a position forward relative to the first surface in the rotation direction of the fan, the second surface having a shroud-side cutoff point and a hub-side cutoff point, wherein the first surface and the second surface define a first predetermined angle, and wherein an angle between (i) a straight line extending from a center of the fan to the shroud-side cutoff point of the second surface and (ii) a straight line extending from the center of the fan to the hub-side cutoff point of the second surface is 15° to 35°.

17. The ventilation device of claim 16, wherein the second duct comprises:

a second hub-side surface;

a second shroud-side surface;

a third surface that connects the second hub-side surface to the second shroud-side surface; and a fourth surface that connects the second hub-side surface to the second shroud-side surface, the fourth surface being disposed at a position forward relative to the third surface in the rotation direction of the fan, and wherein the third surface and the fourth surface define a second predetermined angle about the center of the fan.

* * * * *